US012071760B2

(12) United States Patent
Li et al.

(10) Patent No.: US 12,071,760 B2
(45) Date of Patent: Aug. 27, 2024

(54) ARCH GRID BOLTED SPHERE NODE ROTATING AND FIXING DEVICE AND ARCH GRID MOUNTING SYSTEM

(71) Applicant: China Construction Xinjiang Industrial Energy Engineering Co., Ltd, Urumqi (CN)

(72) Inventors: Qingtong Li, Urumqi (CN); Re Tiemu, Urumqi (CN); Wenjun Chen, Urumqi (CN); Tianqin Zhang, Urumqi (CN)

(73) Assignee: China Construction Xinjiang Industrial Energy Engineering Co., Ltd, Xinjiang (CN)

( * ) Notice: Subject to any disclaimer, the term of this patent is extended or adjusted under 35 U.S.C. 154(b) by 0 days.

(21) Appl. No.: 17/780,625

(22) PCT Filed: Jun. 28, 2021

(86) PCT No.: PCT/CN2021/102814
§ 371 (c)(1),
(2) Date: May 27, 2022

(87) PCT Pub. No.: WO2022/001974
PCT Pub. Date: Jan. 6, 2022

(65) Prior Publication Data

US 2023/0358033 A1 Nov. 9, 2023

(30) Foreign Application Priority Data

Jun. 28, 2020 (CN) ..... 202010597493.7

(51) Int. Cl.
*E04B 1/38* (2006.01)
*E04B 1/32* (2006.01)

(52) U.S. Cl.
CPC .... *E04B 1/3205* (2013.01); *E04B 2001/3217* (2013.01); *E04B 2001/3247* (2013.01)

(58) Field of Classification Search
CPC ..... E04B 1/3205; E04B 2001/3217; E04B 2001/3247; E04B 1/1906; E04B 1/35;
(Continued)

(56) References Cited

U.S. PATENT DOCUMENTS

2017/0350112 A1* 12/2017 Ventrella ..... E04B 1/1906

FOREIGN PATENT DOCUMENTS

CN 206681155 U * 11/2017

* cited by examiner

*Primary Examiner* — Patrick J Maestri
(74) *Attorney, Agent, or Firm* — The Dobrusin Law Firm, P.C.

(57) ABSTRACT

An arch grid bolted sphere node rotating and fixing device and an arch grid mounting system. The device includes a base, a fixing part, and a rotating part. The fixing part includes a groove body, a first vertical plate, and a second vertical plate. The groove body, the first vertical plate, and the second vertical plate are respectively connected to the base. A notch of the groove body is obliquely upward. The first vertical plate and the second vertical plate are respectively located on opposite sides of the groove body. The first vertical plate is provided with a first through hole. The second vertical plate is provided with a second through hole. The first through hole and the second through hole are formed oppositely. The rotating part includes a first rod piece, a rotating sphere, and a second rod piece that are connected in sequence.

19 Claims, 4 Drawing Sheets

(58) Field of Classification Search
CPC ..... E04B 2001/1924; E04B 2001/1957; E04G 21/14; E04G 21/16; E04G 21/163
See application file for complete search history.

ARCH GRID BOLTED SPHERE NODE ROTATING AND FIXING DEVICE AND ARCH GRID MOUNTING SYSTEM

CROSS REFERENCE TO RELATED APPLICATIONS

This application is a US National Phase entry of PCT/CN2021/102814 filed on Jun. 28, 2021, which claims the benefit and priority of Chinese Patent Application No. 202010597493.7, filed on Jun. 28, 2020, the disclosure of which is incorporated by reference herein in its entirety as part of the present application.

TECHNICAL FIELD

The present disclosure relates to the technical field of architectural engineering, and in particular, to an arch grid bolted sphere node rotating and fixing device and an arch grid mounting system.

BACKGROUND ART

In the manufacturing and mounting projects of the existing arch net racks, due to large camber of the net racks, the highest point is usually 10 to 20 meters from the ground. The grid is mounted by conventional methods, the mounting operation process will be carried out at high altitude, the construction risk of personnel is high, and the construction progress is slow, so the construction period is affected.

During mounting a grid, integral mounting is also adopted, and the grid is assembled into a whole by dislocation on the ground (namely, the assembly position is offset from a mounting axis by a certain distance, so as to avoid a base position), and then the grid is hoisted to a design position by using a plurality of hoisting devices. By the method, it is also necessary to carry out an operation at high altitude when a starting span grid is assembled and welded to the middle position of a span, and the starting span grid has a large weight after being integrally assembled on the ground, so four large cranes are required to hoist the starting span grid to the design position, that is, the four cranes are respectively located at the opposite corners of a starting span, after the starting span grid is vertically hoisted to high altitude, the crane arms simultaneously rotate to complete the aerial displacement of the grid until the grid reaches the design position. At this time, the hoisting speed of the four cranes must be kept consistent, otherwise, overload of individual cranes and damage of the grid will occur, and the danger coefficient is also relatively high. Particularly, if the abovementioned mounting method is used for the arch grid, the danger coefficient is larger, so the abovementioned method cannot be used for mounting.

In conclusion, it is necessary to provide a device for mounting an arch grid, so as to improve the safety factor of the mounting of the arch grid.

SUMMARY

An objective of the present disclosure is to provide an arch grid bolted sphere node rotating and fixing device and an arch grid mounting system, so as to solve the problems in the prior art, which can reduce the danger coefficient of arch grid mounting construction.

To achieve the abovementioned objective, the present disclosure provides the following solutions.

The present disclosure provides an arch grid bolted sphere node rotating and fixing device, including a base, a fixing part, and a rotating part.

The fixing part includes a groove body, a first vertical plate, and a second vertical plate. The groove body, the first vertical plate, and the second vertical plate are respectively connected to the base. A notch of the groove body is obliquely upward. The first vertical plate and the second vertical plate are respectively located on opposite sides of the groove body. The first vertical plate is provided with a first through hole. The second vertical plate is provided with a second through hole. The first through hole and the second through hole are formed oppositely.

The rotating part includes a first rod piece, a rotating sphere, and a second rod piece that are fixedly connected in sequence. The rotating sphere is placed in the groove body. The first rod piece is rotatably connected to the first through hole. The second rod piece is rotatably connected to the second through hole.

Preferably, the groove body includes side cross rib plates and a bottom cross rib plate. The side cross rib plates and the bottom cross rib plate are respectively connected to the base. The side cross rib plates and the bottom cross rib plate are spliced in sequence along a plane perpendicular to the first rod piece and the second rod piece, and are used for forming a groove matched with a spherical surface of the rotating sphere.

Preferably, the distance between the first vertical plate and the second vertical plate is slightly greater than the diameter of the rotating sphere.

Preferably, the center of the rotating sphere is located on an extension line of a central axis of the first rod piece and an extension line of a central axis of the second rod piece.

Preferably, a massage and percutaneous medicament permeation device includes a liquid medicine delivery pipe joint, a cavernous body, a massage head, a motor, and an outer housing with an inner side fixedly connected to a mounting plane A or a mounting plane B.

Preferably, a vertical plane and a horizontal plane are arranged at an upper end of the base. The side cross rib plates are connected to the vertical plane. The bottom cross rib plate is connected to the horizontal plane.

The present disclosure further provides an arch grid mounting system, including an arch grid, a jacking mechanism, and an arch grid bolted sphere node rotating and fixing device as described in any one of the preceding items. A bolted sphere node is located on one side of the axial direction of a lower chord surface of the arch grid. The jacking mechanism jacks and is connected to the bolted sphere node on the other side of the axial direction of the lower chord surface of the arch grid.

Preferably, an upper end of the jacking mechanism is connected to a supporting body. The supporting body is provided with a hemispherical groove, and is used for matching the spherical surface of the bolted sphere node.

Compared with the prior art, the present disclosure achieves the following beneficial technical effects.

According to the arch grid bolted sphere node rotating and fixing device and the arch grid mounting system provided by the present disclosure, since the overall arch grid has large weight, long length, and wide span, a section of three-piece grid (starting grid) is assembled and welded on the ground first, a plurality of rotating spheres are arranged in sequence on one side of the axial direction of the lower chord surface of the section of three-piece grid, and a set of arch grid bolted sphere node rotating and fixing device is assembled and welded at each rotating sphere. A plurality of concrete foundations are sequentially cast along the axial direction of the arch grid to be erected. A base of an arch grid bolted sphere node rotating and fixing device is fixed to an upper end of each concrete foundation, so that the arch grid bolted sphere node rotating and fixing device is mounted at the upper end of each concrete foundation. Through the abovementioned assembling, one side of the axial direction of the section of three-piece grid is rotatably connected to the upper ends of the plurality of concrete foundations simultaneously. The other side of the axial direction of the section of three-piece grid is freely overlapped on a temporary supporting frame. At this time, the debugging, inspection, and trial operation of the jacking mechanisms are completed first, and then a jacking mechanism is placed below each of the plurality of bolted sphere nodes (each bolted sphere node corresponds to one rotating sphere) on the other side of the axial direction of the lower chord surface of the three-piece grid. The rotating spheres are placed in the groove body, so the rotating spheres may rotate in the groove body, and the other side of the axial direction of the section of three-piece grid may be jacked up through the jacking mechanisms, so that the other side of the axial direction of the section of three-piece grid is at a suitable height from the ground, which facilitates simultaneous welding of the plurality of bolted sphere nodes on the other side of the axial direction of the section of three-piece grid to a fourth piece of grid. The suitable height may be adjusted by the abovementioned method, so that construction personnel can weld the bolted sphere nodes and the fourth piece of grid on the ground, then jack up the plurality of bolted sphere nodes on the other side of the axial direction of the fourth piece of grid, and weld the bolted sphere nodes and the fifth piece of grid. When the three-piece grid is jacked up, the area and the weight of the three-piece grid are small, and a small number of jacking mechanisms may be arranged along the other side of the axial direction of the three-piece grid (for example, seven jacking mechanisms are arranged for the three-piece grid with the length of 90 meters in the axial direction to meet construction requirements). With the increase of the span of the arch grid, the jacking assembling area and weight of the arch grid gradually increase, and meanwhile, the number of the jacking mechanisms of the jacking grid gradually increases (the jacking mechanisms used for the arch grid with the length of 90 meters in the axial direction finally increases by 12). According to the abovementioned method, jacking and welding are performed in sequence, and finally, the full-span assembling and welding of the whole arch grid is completed. During the abovementioned process, the notch of the groove body faces a top end of the arch grid after the completion of span assembling and welding. The rotating spheres rotate in the groove body. The first rod piece rotates in the first through hole. The second rod piece rotates in the second through hole. When the jacking mechanisms stop jacking up the bolted sphere nodes, the rotating spheres, the first rod piece, and the second rod piece stop rotating respectively. The first rod piece is limited in the first through hole, and the second rod piece is limited in the second through hole, so that the rotating spheres are limited in the groove body, which prevents the rotating spheres from separating from the notch of the groove body in the direction perpendicular to the first rod piece or the second rod piece. Since the first vertical plate and the second vertical plate are respectively and fixedly welded to the base, the first vertical plate, the second vertical plate, and the groove body are matched with each other to fix the positions of the centers of the rotating spheres without offset. When the full-span assembling and welding of the arch grid are completed, the final piece of grid is fixed to the concrete foundations that are rotatably welded on the opposite sides of the rotating spheres, and the edges of the rotating spheres and the groove body are welded together, so as to fix the positional relationship between the rotating spheres and the groove body. At this time, there is fixed mechanical strength between the rotating spheres and the groove body, then first vertical plate and the second vertical plate are cut off, and the rotating spheres cannot be separated from the groove body, so as to ensure that the overall arch grid is stably supported by the concrete foundations. In conclusion, since on-site construction personnel complete the full-span assembling and welding process of the arch grid on the ground, a high-altitude welding operation is avoided, the danger coefficient of the construction is reduced, and the safety of life and property of the personnel is guaranteed.

BRIEF DESCRIPTION OF THE DRAWINGS

To describe the technical solutions in the embodiments of the present disclosure or in the prior art more clearly, the following briefly describes the drawings required for describing the embodiments. Apparently, the drawings in the following description show merely some embodiments of the present disclosure, and those of ordinary skill in the art may still derive other drawings from these drawings without creative efforts.

Figure 1:
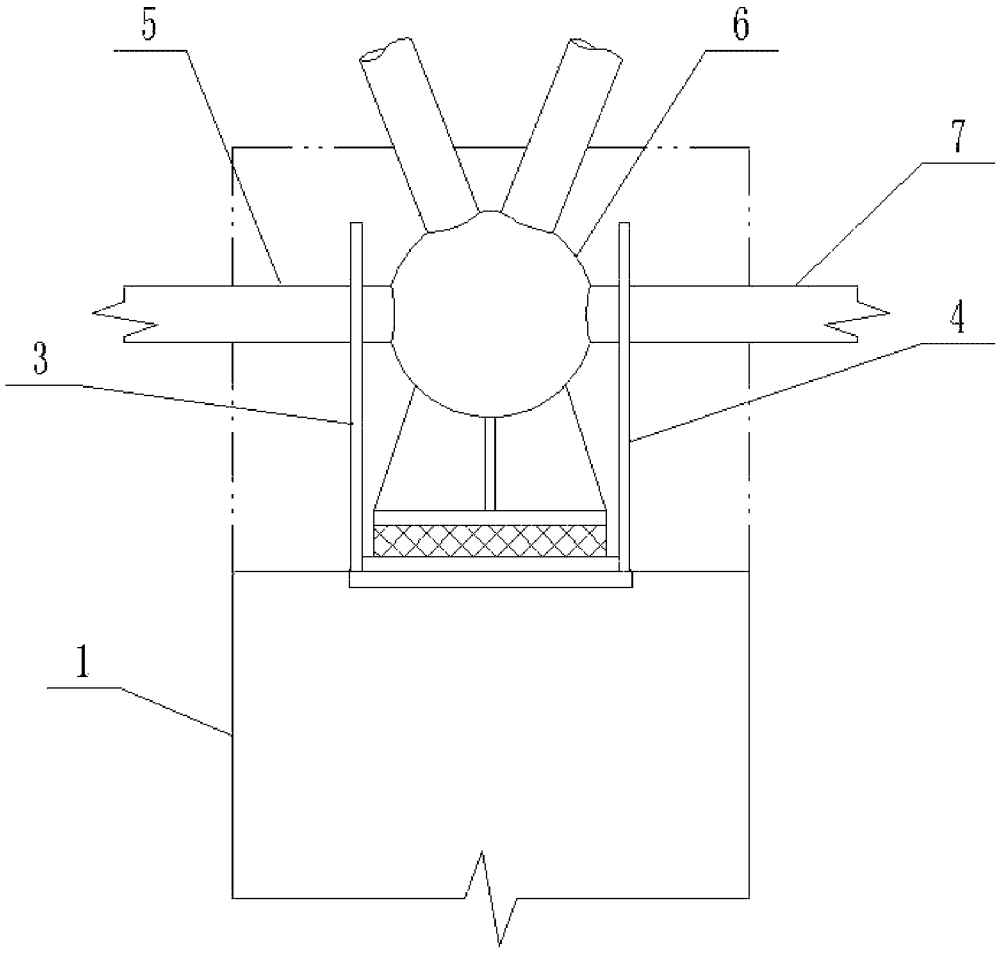
FIG. 1 is a front view of an arch grid bolted sphere node rotating and fixing device of the present disclosure.

Reference signs in the drawings: 1—base, 2—jacking mechanism, 3—first vertical plate, 4—second vertical plate, 5—first rod piece, 6—rotating sphere, 7—second rod piece, 8—side cross rib plate, 9—bottom cross rib plate, 10—arch grid, 11—concrete foundation, 12—supporting body, 13—bolted sphere node, and 14—jacking frame.

DETAILED DESCRIPTION OF THE EMBODIMENTS

Technical solutions in the embodiments of the present disclosure will be clearly and completely described below with reference to the drawings in the embodiments of the present disclosure. Apparently, the described embodiments are merely part rather than all of the embodiments of the present disclosure. On the basis of the embodiments of the present disclosure, all other embodiments obtained by those of ordinary skill in the art without creative work fall within the scope of protection of the present disclosure.

An objective of present disclosure is to provide an arch grid bolted sphere node rotating and fixing device and an arch grid mounting system, so as to solve the problems in the prior art.

In order to make the abovementioned objective, features, and advantages of the present disclosure more apparent and more comprehensible, the present disclosure is further described in detail below with reference to the drawings and specific implementation manners.

Embodiment 1

An arch grid bolted sphere node rotating and fixing device provided by the present embodiment includes a base 1, a fixing part, and a rotating part. The fixing part includes a groove body, a first vertical plate 3, and a second vertical plate 4. The groove body, the first vertical plate 3, and the second vertical plate 4 are respectively connected to the base 1. A notch of the groove body is obliquely upward. The first vertical plate 3 and the second vertical plate 4 are respectively located on opposite sides of the groove body. The first vertical plate 3 is provided with a first through hole. The second vertical plate 4 is provided with a second through hole. The first through hole and the second through hole are formed oppositely.

The rotating part includes a first rod piece 5, a rotating sphere 6, and a second rod piece 7 that are fixedly connected in sequence. The rotating sphere 6 is placed in the groove body. The first rod piece 5 is rotatably connected to the first through hole, and the second rod piece 7 is rotatably connected to a second through hole.

As shown in FIG. 1 to FIG. 4, a working process of the arch grid bolted sphere node rotating and fixing device is as follows.

Since the overall arch grid 10 has large weight, long length, and wide span, a section of three-piece grid (starting grid) is assembled and welded on the ground first, the plurality of rotating spheres 6 are arranged in sequence on one side of the axial direction of the lower chord surface of the section of three-piece grid, and a set of arch grid bolted sphere node rotating and fixing device is assembled and welded at each rotating sphere 6. A plurality of concrete foundations 11 are sequentially cast along the axial direction of the arch grid 10 to be erected. A base 1 of an arch grid bolted sphere node rotating and fixing device is fixed to an upper end of each concrete foundation 11, so that the arch grid bolted sphere node rotating and fixing device is mounted at the upper end of each concrete foundation 11. Through the above-mentioned assembling, one side of the axial direction of the section of three-piece grid is rotatably connected to the upper ends of the plurality of concrete foundations 11 simultaneously. The other side of the axial direction of the section of three-piece grid is freely overlapped on the ground.

At this time, the debugging, inspection, and trial operation of the jacking mechanisms are completed first, and then a jacking mechanism 2 is placed below each of the plurality of bolted sphere nodes 13 (each bolted sphere node 13 corresponds to one rotating sphere 6) on the other side of the axial direction of the lower chord surface of the three-piece grid. The rotating spheres 6 are placed in the groove body, so the rotating spheres 6 may rotate in the groove body, the three-piece grid may rotate by taking the upper ends of the concrete foundations 11 as centers. The other side of the axial direction of the section of three-piece grid is jacked up through the jacking mechanisms 2, so that the other side of the axial direction of the section of three-piece grid is at a suitable height from the ground, which facilitates simultaneous welding of the plurality of bolted sphere nodes 13 on the other side of the axial direction of the section of three-piece grid to a fourth piece of grid. The suitable height may be adjusted by adjusting the jacking mechanisms 2, so that construction personnel can weld the bolted sphere nodes 13 and the fourth piece of grid on the ground, then jack up the plurality of bolted sphere nodes 13 on the other side of the axial direction of the fourth piece of grid again, and weld the bolted sphere nodes 13 and the fifth piece of grid.

When the three-piece grid is jacked up, the area and the weight of the three-piece grid are small, and a small number of jacking mechanisms may be arranged along the other side of the axial direction of the three-piece grid (for example, seven jacking mechanisms are arranged for the three-piece grid with the length of 90 meters in the axial direction to meet construction requirements). With the increase of the span of the arch grid, the jacking assembling area and weight of the arch grid gradually increase, and meanwhile, the number of the jacking mechanisms of the jacking grid gradually increases (the jacking mechanisms used for the arch grid with the length of 90 meters in the axial direction finally increases by 12). According to the abovementioned method, jacking and welding are performed in sequence, and finally, the full-span assembling and welding of the whole arch grid 10 is completed.

During the abovementioned process, the notch of the groove body faces a top end of the arch grid 10 after the completion of span assembling and welding. The rotating spheres 6 rotate in the groove body. The first rod piece 5 rotates in the first through hole. The second rod piece 7 rotates in the second through hole. When the jacking mechanisms 2 stop jacking up the bolted sphere nodes 13, the rotating spheres 6, the first rod piece 5, and the second rod piece 7 stop rotating respectively. The first rod piece 5 is limited in the first through hole, and the second rod piece 7 is limited in the second through hole, so that the rotating spheres 6 are limited in the groove body, which prevents the rotating spheres 6 from separating from the notch of the groove body in the direction perpendicular to the first rod piece 5 or the second rod piece 7. Since the first vertical plate 3 and the second vertical plate 4 are respectively and fixedly welded to the base 1, the first vertical plate 3, the second vertical plate 4, and the groove body are matched with each other to fix the positions of the centers of the rotating spheres 6 without offset. The stability of the rotating spheres 6 above the base 1 is improved.

When the full-span assembling and welding of the arch grid 10 are completed, and the final piece of grid is fixedly welded to the upper ends of the concrete foundations 11 that are rotatably welded on the opposite sides of the rotating spheres 6, the edges of the rotating spheres 6 and the groove body are welded together, so as to fix the positional relationship between the rotating spheres 6 and the groove body. At this time, there is fixed mechanical strength between the rotating spheres 6 and the groove body, then first vertical plate 3 and the second vertical plate 4 are cut off, and the rotating spheres 6 cannot separate from the groove body, so as to ensure that the overall arch grid 10 is stably supported by the concrete foundations 11.

In the technical solution of the present disclosure, since on-site construction personnel complete the full-span assembling and welding process of the arch grid 10 on the ground, a high-altitude welding operation is avoided, the danger coefficient of the construction is reduced, and the safety of life and property of the personnel is guaranteed.

Specifically, the jacking mechanisms 2 adopt hydraulic jacking mechanisms, and the lifting speed and height of hydraulic cylinders are controlled through a Programmable Logical Controller (PLC) numerical control technology. The jacking mechanisms 2 specifically adopt 1150-type hydraulic jacking machines (matched with 650 KN hydraulic jacks). The jacking mechanisms 2 are mounted in a jacking frame 14, and the jacking frame 14 is formed by stacking a plurality of standard sections up and down. When the jacking mechanisms jack up, horizontal displacement will be generated at jacking points, and the maximum horizontal displacement adjustment amount of the jacking frame 14 is 200 mm (100 mm on each of the left and the right). When the horizontal displacement exceeds the displacement amount, it is necessary to adjust by replacing the jacking frame 14. A specific method is that: when the jacking frame 14 is initially mounted, the jacking frame 14 is placed by 100 mm in a direction opposite to the horizontal displacement, and then the horizontal displacement is adjusted by the lifting of the jacking mechanisms 2 in the jacking frame 14 and cooperating the increase of the standard sections of the jacking frame 14. That is, the horizontal displacement is adjusted through eccentric compression of the jacking frame 14. A replacement principle of the jacking frame 14 is to replace the original jacking frame 14 by increasing the jacking frame 14. The original jacking frame 14 moves horizontally after being unloaded, and jacks up and is stressed again, so that the horizontal displacement is eliminated by alternatively jacking by using two groups of jacking frames 14 back and forth.

Steps to eliminate the horizontal displacement of the jacking frame 14 itself are as follows.

Hydraulic cylinders of the jacking mechanisms 2 extend out of the jacking frame 14, so as to jack up the arch grid more than the height of a standard section of the jacking frame.

A standard section is added, and a hydraulic cylinder of a jacking mechanism 2 drops, so that a jacking upper bracket falls onto an upper cross bar of the newly added standard section, and the upper bracket is stressed.

The hydraulic cylinder of the jacking mechanism 2 continues dropping to lift a jacking lower bracket. At this time, the jacking mechanism 2 is not stressed, and the jacking mechanism 2 is moved in the direction of the horizontal displacement. The hydraulic cylinder of the jacking mechanism 2 jacks up the arch grid, and the upper bracket is not stressed, and the upper bracket is moved in the direction of the horizontal displacement.

The abovementioned steps are repeated, so as to continuously jack up the arc grid 10 while eliminating the horizontal displacement until the jacking frame cannot continue eliminating the horizontal displacement.

Figure 2:
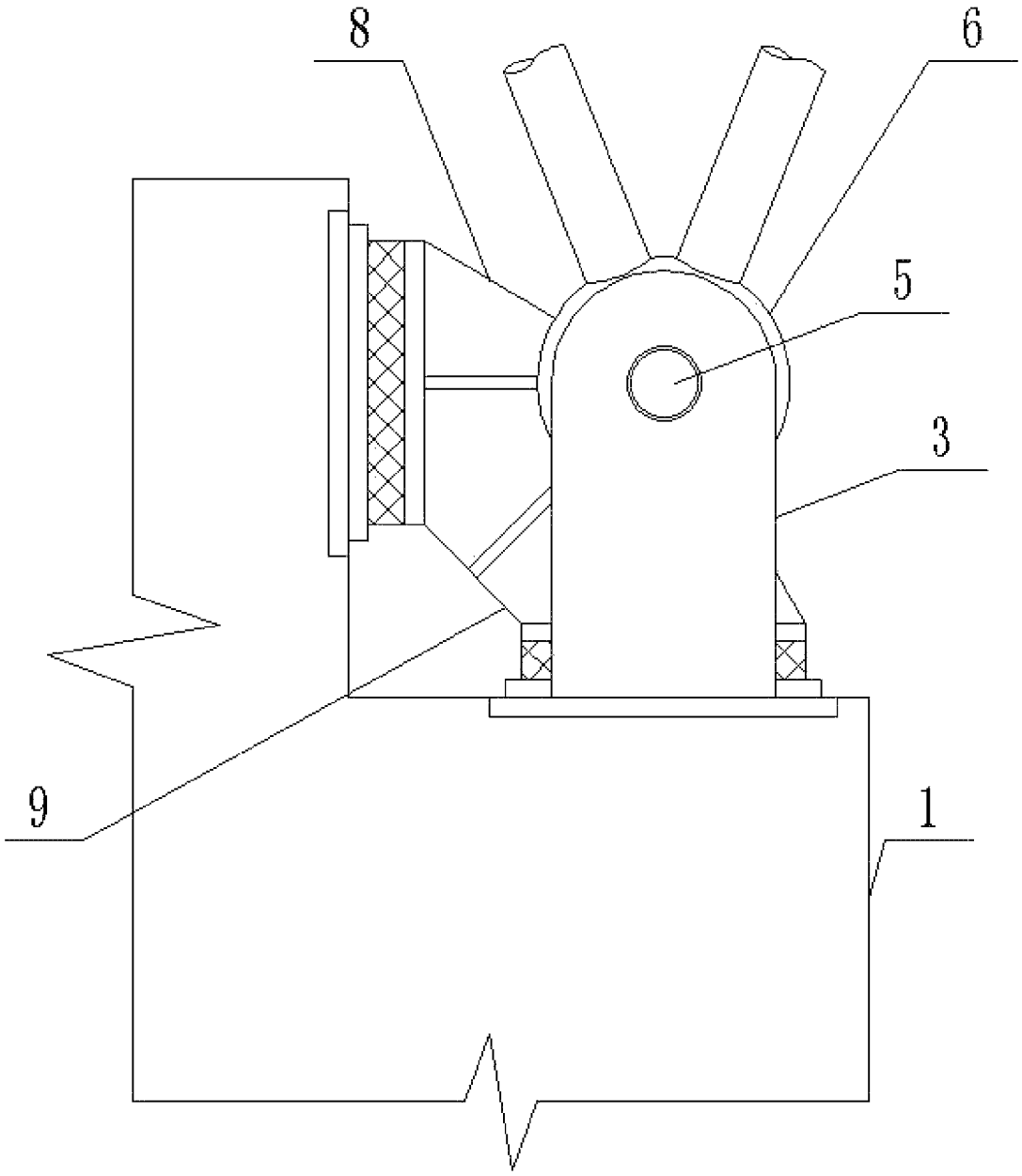
FIG. 2 is a side view of the arch grid bolted sphere node rotating and fixing device of the present disclosure.

As shown in FIG. 1 and FIG. 2, in a specific implementation manner, the groove body includes side cross rib plates 8 and a bottom cross rib plate 9. The side cross rib plates 8 and the bottom cross rib plate 9 are respectively connected to the base 1. The side cross rib plates 8 and the bottom cross rib plate 9 are spliced in sequence along the plane perpendicular to the first rod piece 5 and the second rod piece 7, and are used for forming a groove matched with a spherical surface of rotating sphere 6.

In the present implementation manner, specifically, the side cross rib plates 8 and the bottom cross rib plate 9 are respectively connected to the base 1 by bolts. After the full-span assembling of the arch grid 10 is completed, and when the relative positions of the rotating spheres 6 and the groove body need to be welded and fixed, compared with other forms of groove bodies, contour lines of the surfaces, that are respectively in contact with the rotating spheres 6, of the side cross rib plates 8 and the bottom cross rib plate 9 are long, that is, gaps, that may be welded by electric welding, of the spherical surfaces of the rotating spheres 6 are long, so as to further ensure the strength of mechanical structures stably connected to the rotating spheres 6, the groove body, the base 1, and the concrete foundations 11.

As shown in FIG. 1, in a specific implementation manner, the distance between the first vertical plate 3 and the second vertical plate 4 is slightly greater than the diameter of the rotating sphere 6.

In the present implementation manner, specifically, the distance between the first vertical plate 3 and the second vertical plate 4 is slightly greater than the diameter of the rotating sphere 6. During rotating of the rotating sphere 6, the rotating sphere 6 is prevented from swinging reciprocally along the axis direction thereof, and the stability of the arch grid 10 when being jacked up is improved.

As shown in FIG. 1, in a specific implementation manner, the center of the rotating sphere 6 is located on an extension line of a central axis of the first rod piece 5 and an extension line of a central axis of the second rod piece 7.

In the present implementation manner, specifically, the rotating sphere 6, the first rod piece 5, and the second rod piece 7 rotate coaxially. During rotating of the rotating sphere 6, the rotating sphere 6 is prevented from being subjected to torque resistance from the third vertical plate 3 and the second vertical plate 4.

As shown in FIG. 1 and FIG. 2, in a specific implementation manner, a vertical plane and a horizontal plane are arranged at an upper end of the base 1. The side cross rib plates 8 are connected to the vertical plane. The bottom cross rib plate 9 is connected to the horizontal plane.

In the present embodiment, specifically, the side cross rib plates 8 are connected to the vertical surface by bolts, and the bottom cross rib plate 9 is connected to a horizontal surface by bolts. The side cross rib plates 8 are subjected to a supporting force of the vertical surface and exerts a side supporting force on the rotating sphere 6. The bottom cross rib plate 9 is subjected to a supporting force of the horizontal surface and exerts a vertically upward supporting force on the rotating sphere 6, so that the direction of a resultant force on the rotating sphere 6 is kept consistent with the direction of the notch of the groove body all the time, while the direction of the notch of the groove body obliquely faces the direction of the supporting force of the jacking mechanism 2 to the arch grid 10, that is, the direction of the resultant force of the supporting force of the groove body to the arch grid 10 and the supporting force of the jacking mechanism 2 to the arch grid 10 is vertically upward, which meets the requirements of mounting construction of the arch grid 10.

Embodiment 2

Figure 3:
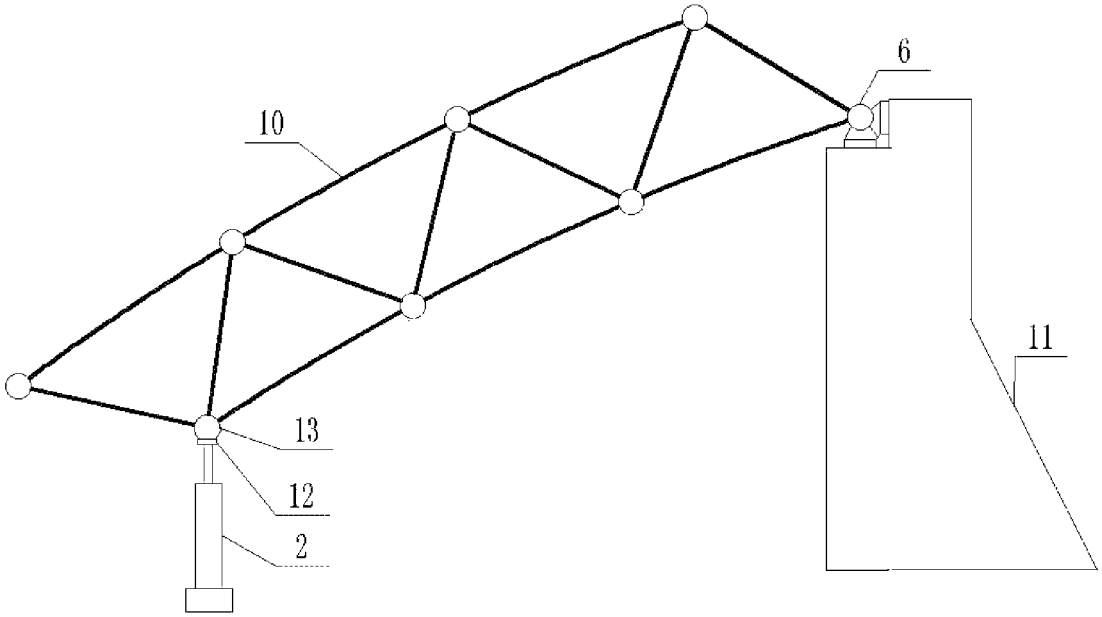
FIG. 3 is a structural schematic diagram of an arch grid mounting system of the present disclosure.
Figure 4:
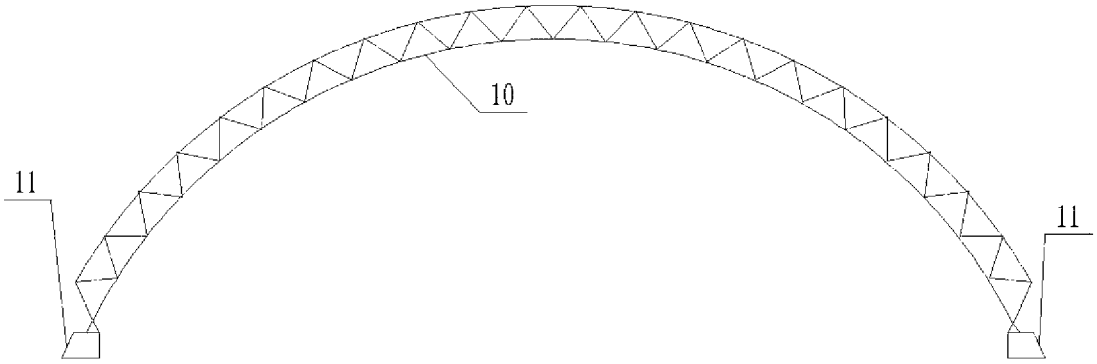
FIG. 4 is a structural schematic diagram when the mounting of a full-span arch grid of the present disclosure is completed.

As shown in FIG. 1 to FIG. 3, the present embodiment provides an arch grid mounting system. The system includes an arch grid 10, a jacking mechanism 2, and an arch grid bolted sphere node rotating and fixing device as described in any one of the preceding items. The rotating spheres 6 are located on one side of the axial direction of a lower chord surface of the arch grid 10. The jacking mechanism 2 jacks and is connected to the bolted sphere node 13 on the other side of the axial direction of the lower chord surface of the arch grid 10.

In the present implementation manner, specifically, the jacking mechanisms 2 cooperate with the arch grid bolted sphere node rotating and fixing device. The jacking mechanisms 2 jack and are connected to the bolted sphere nodes 13 in sequence along the span direction of the arch grid, so that on-site construction personnel can weld a single-piece grid and the bolted sphere nodes 13 on the ground in sequence, and finally, the overall assembling and welding of the arch grid 10 is completed.

As shown in FIG. 3, in a specific implementation manner, an upper end of the jacking mechanism 2 is connected to a supporting body 12. The supporting body 12 is provided with a hemispherical groove, and is used for matching the spherical surface of the bolted sphere node 13.

In the present implementation manner, specifically, an upper end of a hydraulic cylinder of the jacking mechanism 2 is welded to the supporting body 12. A hemispherical groove is formed in an upper end face of the supporting body 12. A lower hemispherical surface of the bolted sphere node 13 is embedded into the hemispherical groove. During a process of jacking up the bolted sphere node 13 by the jacking mechanism 2, the bolted sphere node 13 revolves a certain angle by taking the rotating sphere 6 as a center, so the spherical surface of the bolted sphere node 13 slides relative to the hemispherical groove, but the bolted sphere node 13 cannot separate from the hemispherical groove, which ensures that the jacking mechanism 2 continuously jacks up the bolted sphere node 13.

In this specification, specific examples are used to describe the principle and implementation manners of the present disclosure. The description of the embodiments above is merely intended to help understand the method and core idea of the present disclosure. In addition, those skilled in the art may make modifications based on the idea of the present disclosure with respect to the specific implementation manners and the application scope. In conclusion, the content of the present specification shall not be construed as a limitation to the present disclosure.

What is claimed is:

1. An arch grid bolted sphere node rotating and fixing device, comprising a base, a fixing part, and a rotating part, wherein the fixing part comprises a groove body, a first vertical plate, and a second vertical plate; the groove body, the first vertical plate, and the second vertical plate are respectively connected to the base; a notch of the groove body is obliquely upward; the first vertical plate and the second vertical plate are respectively located on opposite sides of the groove body; the first vertical plate is provided with a first through hole; the second vertical plate is provided with a second through hole; the first through hole and the second through hole are formed oppositely;

the rotating part comprises a first rod piece, a rotating sphere, and a second rod piece that are fixedly connected in sequence; the rotating sphere is placed in the groove body; the first rod piece is rotatably connected to the first through hole; and the second rod piece is rotatably connected to the second through hole;

wherein the groove body comprises side cross rib plates and a bottom cross rib plate; the side cross rib plates and the bottom cross rib plate are respectively connected to the base; and the side cross rib plates and the bottom cross rib plate are spliced in sequence along a plane perpendicular to the first rod piece and the second rod piece, and are used for forming a groove matched with a spherical surface of the rotating sphere.

2. The arch grid bolted sphere node rotating and fixing device according to claim 1, wherein a distance between the first vertical plate and the second vertical plate is slightly greater than a diameter of the rotating sphere.

3. The arch grid bolted sphere node rotating and fixing device according to claim 1, wherein a center of the rotating sphere is located on an extension line of a central axis of the first rod piece and an extension line of a central axis of the second rod piece.

4. The arch grid bolted sphere node rotating and fixing device according to claim 1, wherein the base comprises a vertical plane and a horizontal plane at an upper end thereof; the side cross rib plates are connected to the vertical plane; and the bottom cross rib plate is connected to the horizontal plane.

5. An arch grid mounting system, comprising an arch grid, a jacking mechanism, and the arch grid bolted sphere node rotating and fixing device according to claim 1, wherein a bolted sphere node is located on a side of an axial direction of a lower chord surface of the arch grid; and the jacking mechanism jacks and is connected to a node sphere on another side of the axial direction of the lower chord surface of the arch grid.

6. The arch grid mounting system according to claim 5, wherein an upper end of the jacking mechanism is connected to a supporting body; and the supporting body is provided with a hemispherical groove, and is used for matching the spherical surface of the bolted sphere node.

7. The arch grid bolted sphere node rotating and fixing device according to claim 1, wherein a center of the rotating sphere is located on an extension line of a central axis of the first rod piece and an extension line of a central axis of the second rod piece.

8. The arch grid bolted sphere node rotating and fixing device according to claim 2, wherein a center of the rotating sphere is located on an extension line of a central axis of the first rod piece and an extension line of a central axis of the second rod piece.

9. The arch grid mounting system according to claim 5, wherein the groove body comprises side cross rib plates and a bottom cross rib plate; the side cross rib plates and the bottom cross rib plate are respectively connected to the base; and the side cross rib plates and the bottom cross rib plate are spliced in sequence along the plane perpendicular to the first rod piece and the second rod piece, and are used for forming a groove matched with a spherical surface of the rotating sphere.

10. The arch grid mounting system according to claim 5, wherein a distance between the first vertical plate and the second vertical plate is slightly greater than a diameter of the rotating sphere.

11. The arch grid mounting system according to claim 5, wherein a center of the rotating sphere is located on an extension line of a central axis of the first rod piece and an extension line of a central axis of the second rod piece.

12. The arch grid mounting system according to claim 9, wherein a center of the rotating sphere is located on an extension line of a central axis of the first rod piece and an extension line of a central axis of the second rod piece.

13. The arch grid mounting system according to claim 10, wherein a center of the rotating sphere is located on an extension line of a central axis of the first rod piece and an extension line of a central axis of the second rod piece.

14. The arch grid mounting system according to claim 9, wherein the base comprises a vertical plane and a horizontal plane at an end thereof, the side cross rib plates are connected to the vertical plane; and the bottom cross rib plate is connected to the horizontal plane.

15. The arch grid mounting system according to claim 9, wherein an upper end of the jacking mechanism is connected to a supporting body; and the supporting body is provided with a hemispherical groove, and is used for matching the spherical surface of the bolted sphere node.

16. The arch grid mounting system according to claim 10, wherein an upper end of the jacking mechanism is connected to a supporting body; and the supporting body is provided with a hemispherical groove, and is used for matching the spherical surface of the bolted sphere node.

17. The arch grid mounting system according to claim 11, wherein an upper end of the jacking mechanism is connected to a supporting body; and the supporting body is provided with a hemispherical groove, and is used for matching the spherical surface of the bolted sphere node.

18. The arch grid mounting system according to claim 12, wherein an upper end of the jacking mechanism is connected to a supporting body; and the supporting body is provided with a hemispherical groove, and is used for matching the spherical surface of the bolted sphere node.

19. The arch grid mounting system according to claim 13, wherein an upper end of the jacking mechanism is connected to a supporting body; and the supporting body is provided with a hemispherical groove, and is used for matching the spherical surface of the bolted sphere node.

* * * * *